United States Patent [19]

Wilke

[11] Patent Number: 4,592,604

[45] Date of Patent: Jun. 3, 1986

[54] PIECE OF FURNITURE, PARTICULARLY CABINET

[76] Inventor: Rudolf Wilke, Marsberger Str. 2, D-3548 Arolsen, Fed. Rep. of Germany

[21] Appl. No.: 358,649

[22] Filed: Mar. 16, 1982

[51] Int. Cl.[4] ..... E05D 5/04

[52] U.S. Cl. ..... 312/245; 16/221; 16/386

[58] Field of Search ..... 312/224, 138 R, 227, 312/326, 327, 242, 245, 249; 16/221, 386, DIG. 37

[56] References Cited

U.S. PATENT DOCUMENTS

| | | | |
|---|---|---|---|
| 876,159 | 1/1908 | Erickson | 312/248 |
| 3,150,903 | 9/1964 | Chapman et al. | 312/138 R |
| 3,911,528 | 10/1975 | Rojic | 16/222 |

*Primary Examiner*—William E. Lyddane
*Assistant Examiner*—Joseph Falk

[57] ABSTRACT

Piece of furniture, particularly cabinet, with a bottom plate, a top plate, and side walls, whose extremeties are seated in elongated slots of supporting arms arranged parallel, superpositioned, and juxtaposed each other, which have receiving openings bordering on their front facing sides, and with at least one door panel secured to two selected supporting arms by means of hinges defining a hinge axis, which comprise frame portions with attachments projecting into the receiving openings and wing portions connecting the door panel rotatably with the frame portions, wherein the frame portions consist of bearing pins (24) insertable into the receiving openings, whereas the wing portions are connected rotatably with the frame portions, however undisplaceably in the direction of the hinge axis and are arranged at the ends of a bearing body extending between the frame portions, which has an elongated slot (43) in which the hinge-side edge of the door panel is concealed, as well as laterally and elevationally adjustably arranged.

14 Claims, 11 Drawing Figures

PIECE OF FURNITURE, PARTICULARLY CABINET

This invention relates to a piece of furniture of the class defined in the overall concept of Claim 1.

With furniture of this type (German Utility Mode Patent No. 6,806,393) the wing elements of the hinges are, on the one hand, arranged to be displaceable and removable in the direction of the hinge axis on the frame elements and, on the other hand, are rotatable by means of wood screws, are however otherwise mounted undisplaceable in the door panels. As a result of this arrangement, following the mounting of the hinges there is no further possibility of adjusting the position of the door panel with respect to the piece of furniture unless one would, following another removal of the door panel, screw the wood screws more or less deeply into the same. If use is made of such an adjustment possibility, the seat of the hinge at the door panel, which is in any event nor very solid, is impaired even further. In the case of door panels made of glass or the like, the known hinges cannot be used at all.

The use of such hinges in the assembly of doors to pieces of furniture, which are assembled out of supporting arms mounted individually and independently of one another to the wall and of walls and plates loosely inserted therein (German Utility Model Patent No. 6,806,393, German OLS No. 2,905,031) has as a prerequisite a very high degree of precision in the mounting of the supporting arms, because even the most minute defects in alignment and position of the supporting arms result in the side walls and the top, respectively bottom, plates do not form an exact rectangle or square. Following mounting of the doors this is visible above all else through uneven door gaps. In that regard, the vertical gaps between the door and the side walls of the piece of furniture, as well as the vertical gaps between two door panels, which are mostly in the direct visual range, are particularly critical. Critical is however also, because it is readily visible, the possible displacement in elevation between two door panels, whereas uneven gaps at the upper and the lower extremities of the door are not so readily apparent because they are mostly not arranged in the direct visual range.

The known hinges, on account of their inadequacies explained above, do not permit a complete compensation for such unevennesses following the assembly of the door panels and are therefore not very practical for the craftsman and in particular not for the do-it-yourselfer. There exists therefore a need for door bearings by means of which inaccuracies in the mounting of the supporting arms can still be readily compensated for even after the inserting of the door panels.

To avoid the inadequacies referred to above, there could admittedly be provided, for example, likewise known adjustable hinges that are customarily used on clothes, kitchen, or medicine cabinets, or constructions in the manner of subconstructions as they are known for the adjustable mounting of room doors to frames. Such door bearings have however as a prerequisite, on the one hand, stable securing possibilities for the frame elements of the hinges, which above all do not exist with the furniture referred to (German Utility Model Pat. No. 6,806,393,, German OLS No. 2,805,031) and, on the other hand, are as a rule undesirable on account of appearance as well as of cost.

It is the object of the invention to improve a piece of furniture of the type referred to above in such a way that a stable mounting and ready adjustment of the door panel in its assembled state and nevertheless an economical manufacture is possible. Moreover, there is to be provided a fitting intended for the opening and closing of the door panel, which could be readily adapted to the position of the door panel required in a particular instance.

To solve this object, the characterizing features of Claim 1 have been provided.

The form of the bearing body in accordance with the invention is advantageous with regard to product engineering and price considerations especially if it consists of a tubular facing, because the facing can be manufactured to be thin-walled and with a uniform wall thickness. As a result there is no warping even if the bearing body is made of plastics material by injection molding. What is furthermore advantageous is that the bearing body can, without any significant additional cost, be imparted the same cross-section as the supporting arms, which is desirable for theoretical reasons. An essential advantage results, finally, from the concealing of the door panel edge on the side of the hinge by the bearing body. For this makes possible a placing on this door panel edge at an angle, without this being visible from the outside and, as a result, a reduction in the comparability of the gap that is always visible on the side of the door panel opposite the hinge side.

According to the invention there is produced the additional advantage that those supporting arms on which the door panel is mounted are interconnected via the door panel itself and are thereby stabilized. Additional bearing rods or the like for the stabilization or setting of the spacing of the carrying framework formed out of the supporting arms are therefore unnecessary even if there are provided individually arranged supporting arms that are not braced with respect to one another. Contrary to hinges with which the wing elements are merely slid onto the frame elements (German Utility Model Patent No. 6,806,393), the weight of the door is furthermore distributed at all times over all of the supporting arms provided for the bearing of the door panels, even if their assembly has not been carried out with extreme precision. Moreover, there is obtained the assembly advantage that the door panel, even after its firm mounting into the hinges and after their firm mounting into the supporting arms, can still be brought into the desired position and can then be fixed in same. It is likewise advantageous that the panel elements can be economically manufactured of plastics material so that the bearing of the door can, in spite of its advantageous functions, be manufactured economically on the whole.

Moreover, the clamping bushings permit a preassembly of the hinges and a subsequent application of the tubular facings in the color desired in a particular instance, with the facings being designed in such a way that they conceal the mounting elements required for the securing of the door panel to the clamping bushings. The same hinges and bearing tubes, respectively facings, can also be provided on the opposite side of the door thereby imparting an attractive appearance. If the hinges are of identical form and are arranged in mirror symmetry, the door panel can be mounted on both sides of the door on being in each side rotated by 180°. This produces the additional advantage that the elongated slot does not have to be arranged centrally in the bearing tube, respectively in the tubular facing, and that, therefore, the door panel can be arranged forwardly of the axis of rotation.

The invention is described below in further detail on exemplified embodiments in connection with the annexed drawing, in which.

Figure 1:
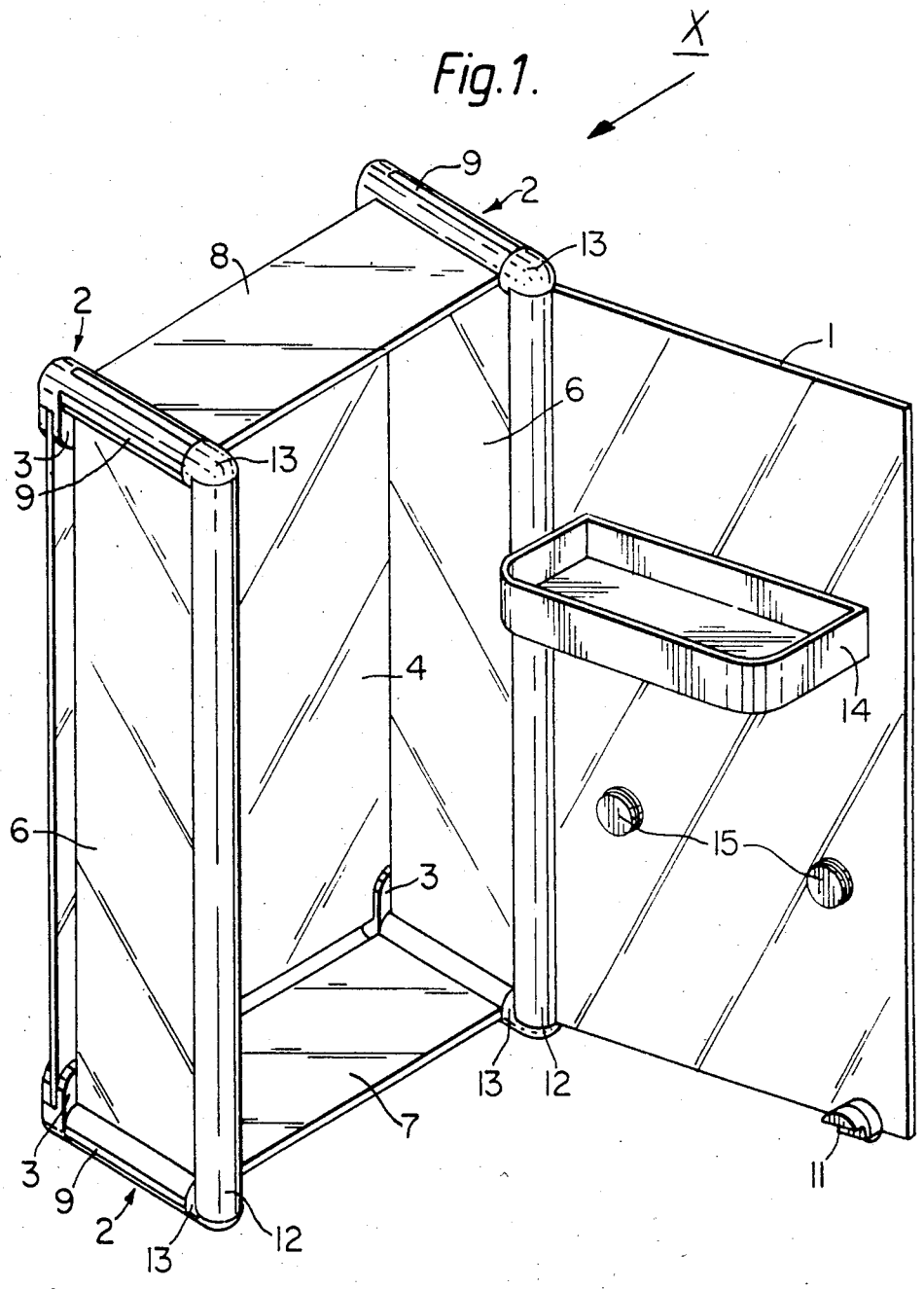
FIG. 1 is a perspective view of a mirror cabinet with one door in an open condition according to a first embodiment of the invention.

FIGS. 1 to 7 illustrate a mirror cabinet with one door panel 1. The mirror cabinet comprises at each one of its four corners a supporting arm 2 secured in any desired manner to the wall, designed for instance in accordance with the German OLS No. 2,905,031 and provided at its side facing the wall with a mirror holder 3. The mirror holders 3 have slots extending perpendicularly to the longitudinal axes of the supporting arms 2, into which a mirror 4 is inserted which, following assembly of the supporting arms 2, is arranged close to the wall and parallel thereto and constitutes the rear wall of the mirror cabinet.

Parallel to their longitudinal axis and offset in each case by 90°, the supporting arms 2 have longitudinal grooves 5 (FIGS. 2 and 5) into which there are inserted the side walls 6, a bottom plate 7 and a top plate 8 that consist for instance of a colored, however transparent, material. Into the longitudinal grooves 5 that are not being used in a particular case there are inserted elongated filler elements 9.

At the front sides of their front ends the supporting arms 2 of the right or left side of the cabinet carry hinges 10 (FIGS. 4–6) to which the door panel 1 is mounted in such a way that it can be rotated forwardly and outwardly, respectively opened. Serving as a handle is a fitting 11 secured to the door panel 1, which has at the same time a locking function and serves to keep the door panel by a positive locking action in its closed state. Moreover, the door panel 1 has at least on its front side, preferably however also on its back side, mirror surfaces or consists of plate glass panes cemented to one another. The hinges 10 secured to the supporting arms 2 are concealed by means of vertically extending facings 12, for instance in the shape of tubes, and cover caps 13, in order that an attractive appearance results.

On the inside of the door panel 1 there are mounted at least along one plane, and preferably along a plurality of planes, storage elements 14 that consist preferably of storage trays in order to prevent a dropping of the utensils stored therein during opening and closing of the door panel 1. For the detachable mounting of these storage elements 14 there are cemented to the inside of the door panel 1 holding elements 15 (not illustrated in greater detail) onto which there are slidably mounted the carrier elements 16 situated on the rear side of the storage elements 14, which permit ready removal of the storage elements 14 for cleaning or the like.

Figure 2:
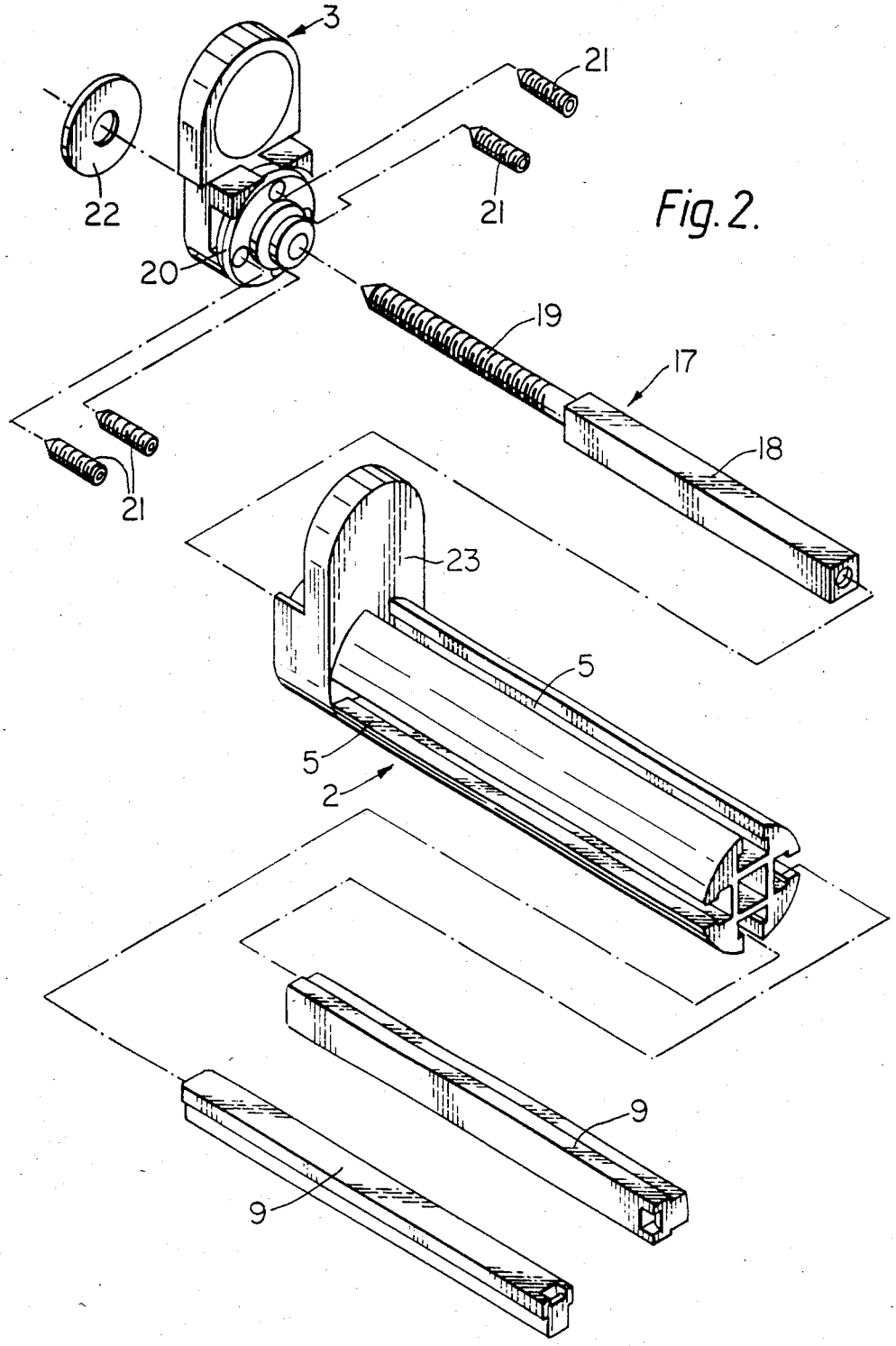
FIG. 2 is an exploded view of the left lower supporting arm of the cabinet of FIG. 1.

According to FIG. 2 and German OLS No. 2,905,031, each supporting arm 2 is designed as a plastics material rod of circular cross-section. Its longitudinal grooves 5 extend in depth up into proximity of a square bore by means of which the supporting arm 2 is slidably mounted onto a carrier or stay bolt 17 whose section 18 arranged in the supporting arm 2 is of square configuration, whose section 19 projecting from the supporting arm 2 is however provided with a screw thread for screwing into a wall bore and with a sharp point. At its end facing the wall, the stay bolt 17 is furthermore provided with an end flange 20 into which setscrews 21 are screwed in from the outer front side, which terminate at a circular steel disk 22 that is traversed by the stay bolt 17, closes flush with the wall-side contact surface of the end flange 20, and jointly with the setscrews 21 permits, following securing of the stay bolt to the wall, a precise perpendicular orientation of the supporting arm 2 with respect to the wall. Moreover, the end flanges 20 can carry the mirror supports 3 in which case there are arranged at the wall-side end of each supporting arm 2 only counterpieces 23, and the end flanges 20 and the counterpieces 23 have corresponding undercuts which, upon the sliding of the supporting arms 2 onto the stay bolts 17, form a snap-in connection and fix the supporting arms a axially.

The hinge 10 (FIGS. 3–6) provided at the front end of each supporting arm 2 of the right or left side of the cabinet has a frame element in the form of a bearing pin 24 that is square in shape, that can be plugged into the square bore of the supporting arm 2 and is locked therein by means of a spring bolt 25, has an extension 26 projecting into a central bore of the stay bolt 17, and is therefore not only non-rotatably secured in the supporting arm 2, but is also additionally braced in the stay bolt 17. The cross-bore accommodating the spring bolt 25 terminates appropriately in a longitudinal groove 5 so that it is accessible only after removal of the filler element 9 or the like borne therein for pusposes of loosening the spring bolt 25.

Figure 3:
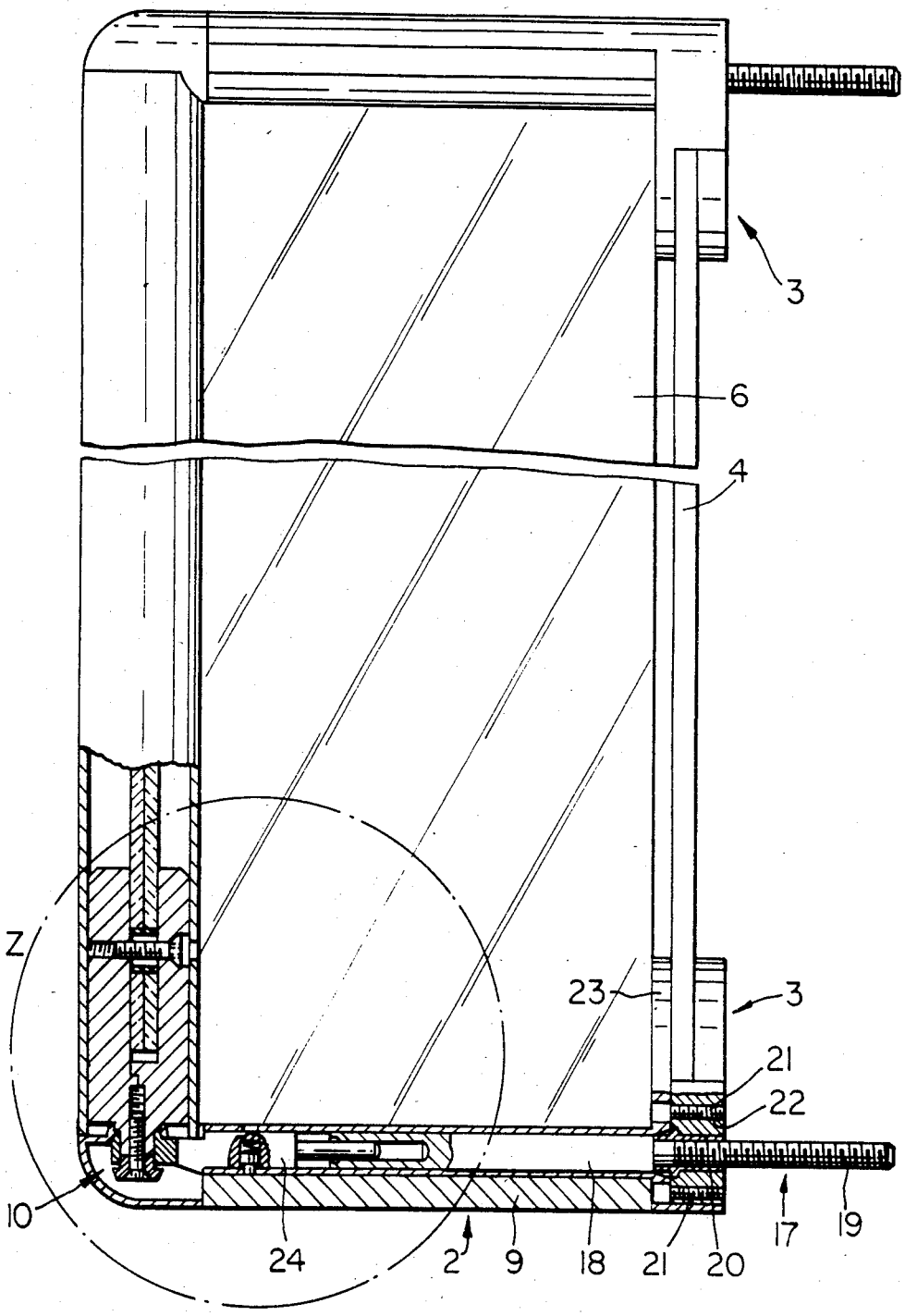
FIG. 3 is the right side elevation view of the cabinet of FIG. 1 as viewed in the direction of arrow X and partially broken and on an enlarged scale with the door in a closed condition.
Figure 4:
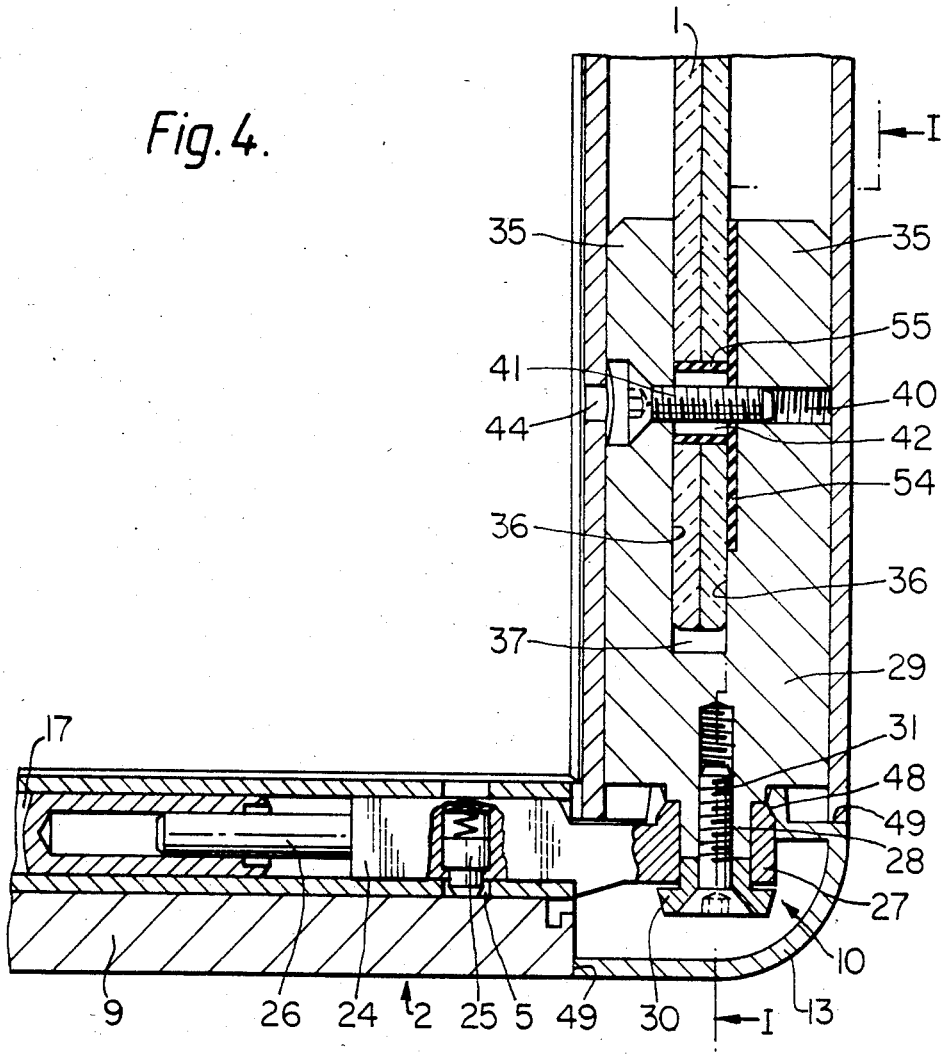
FIG. 4 is the hinge area denoted by "Z" in FIG. 3, shown on an enlarged scale but as viewed in a direction opposite to arrow X in FIG. 1.
Figure 5:
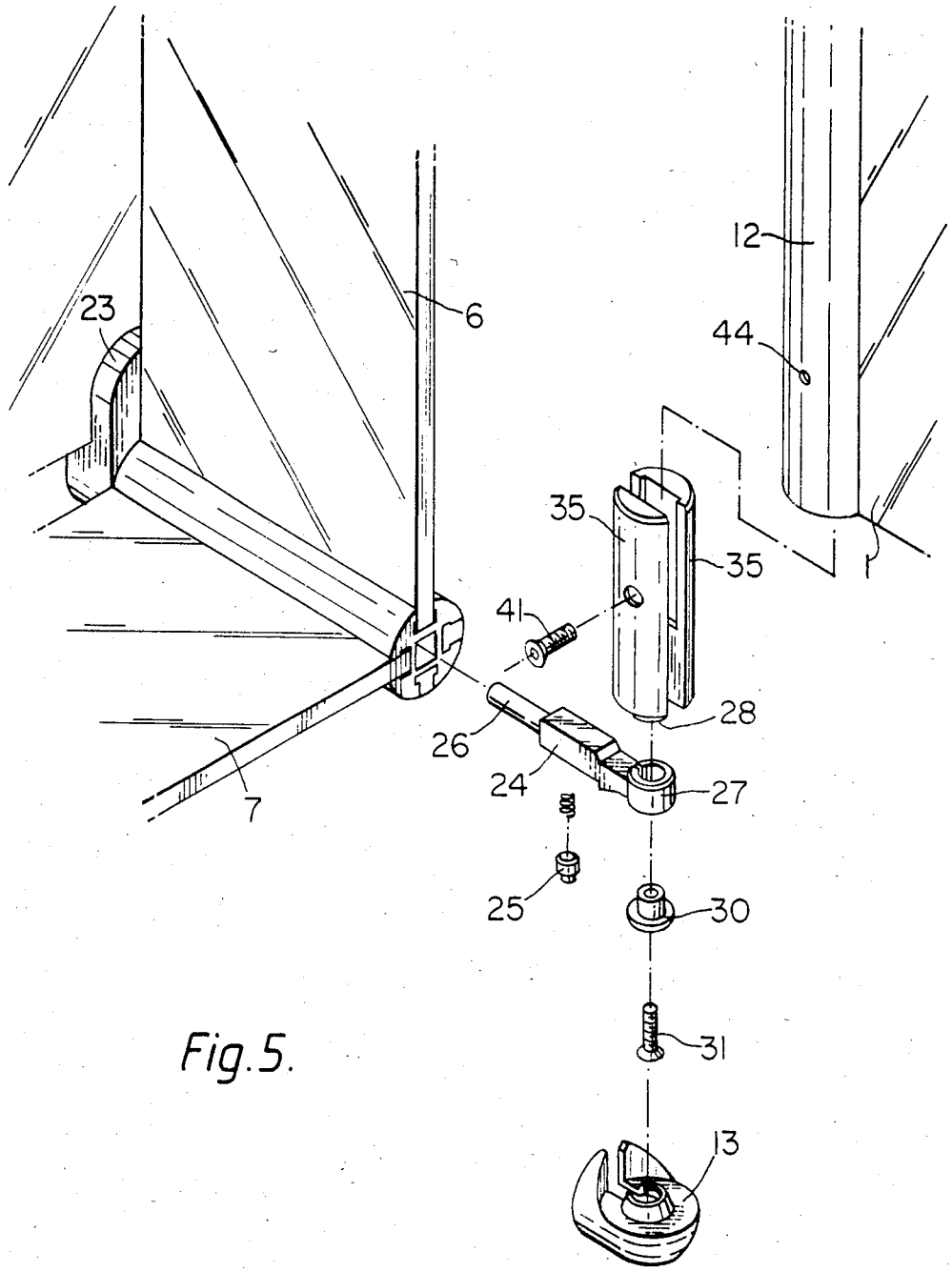
FIG. 5 is an exploded view of the lower hinge area as shown in FIGS. 1 and 3 with the door in an open condition.

The front end of the bearing pin 24 projecting from the supporting arm 2 has a cylindrical sleeve 27 with a hinge axis extending perpendicular to the longitudinal axis of the bearing pin 24. Into the sleeve 27 there extends, coaxial therewith, a cylindrical projection 28 of a clamping bushing 29 that forms the wing section of the hinge 10. For fastening, a holding cap 30 is used whose enarged head has a larger cross-section than the sleeve 27 and which, according to FIGS. 4 and 5, is secured by means of a setscrew 31 to the front side end of the projection 28. Sleeve 27 sits readily rotatable on the projection, even after the tightening of set screw 31. The resultant spacing between the head and the sleeve 27 is shown exaggeratedly in FIG. 3 and should be so small that the clamping bushing 29 is secured to the associated bearing pin 24 rotatably, however undisplaceably in the direction of the hinge axis, and as much as possible without any clearance.

The described form of the supporting arms 2 and the hinges 10 permits a symmetrical arrangement of these parts to the upper, respectively to the lower, end of the door panel by using identical parts, even though the clamping bushing 29 does point downwardly at the upper door panel and upwardly at the lower door panel.

In order that the arrangement of the door panel 1 can still be changed even after the inserting of the hinges 19 into the supporting arms 2 and in particular that in each case the narrow gap 32, 33, and 34 (FIG. 6) of constant width can be set between the side edges of the door panel 1 that are not being held by hinges and the facing 12, respectively the bottom plate 7 and the top plate 8, the door panel 1 is indeed non-rotatable about all axes arranged in its median plane, is however secured to the two clamping bushings 29 to be slidable parallel to its median plane. To this end, the clamping bushings 29 have two clamping jaws 35 embracing the door panel 1 in the manner of a clip, which, with their clamping surfaces 36 arranged parallel to the median plane of the door panel 1, define a U-shaped receiving gap 37 for the door panel 1 (FIGS. 4 and 5). The bottom of the receiving gap 37 is chamfered along a line 38 (FIG. 6) and the portions of the door panel 1 to be inserted into the receiving gap 37 have corresponding cut-outs 39. This results in the advantage that the clamping bushings 29 can be formed in one piece and solid at their outer ends and that even in the case of an axially short mode of construction there remains sufficient room to form the bore for the setscrew 31. The cutouts 39 are preferably formed symmetrical.

The clamping jaws 35 are traversed by coaxial bores 40 (FIGS. 4 and 5), oriented perpendicular to the clamping surfaces 36, one of which is a threaded bore so that the two clamping jaws 35 can be elastically tensioned toward one another by the screwing in of a clamping screw 41, in particular if the clamping bushings 29 are made of plastics material. The parts of the door panel 1 to be inserted into the receiving gap 37 have a corresponding bearing bore 42 whose cross-section is larger than the cross-section of the clamping screw 41. As a result, the door panel can, within the limits defined by the bearing bore 42, be displaced parallel to its median plane and subsequently be fixed in this position by clamping through tightening of the clamping screws 41. On account of the clamping effect, one single clamping screw 41 is here sufficient for each clamping bushing 29, which reduces to a minimum the forming of costly bores in the door panel 1, particularly if plate glass doors are involved.

The tubular facings 12 provided for the covering of the clamping bushings 29 have in each instance a longitudinal slot 43 (FIG. 7) for the accommodating of the door panel 1, as a result of which the facings 12 are maintained non-rotatably on the clamping bushings 29. In the region of the clamping screws 41, each facing 12 has moreover a small assembly bore 44 (FIGS. 4, 5 and 7) through which it is possible to actuate the clamping screws 41 even after the assembly of the mirror cabinet. These assembly bores 44 preferably lie on the inside the facings 12, so that they are visible only when the door is open. Moreover, as clamping screws 41 one uses preferably small socket-head cap screws, so that the assembly bores 44 can be kept as small as possible.

Figure 6:
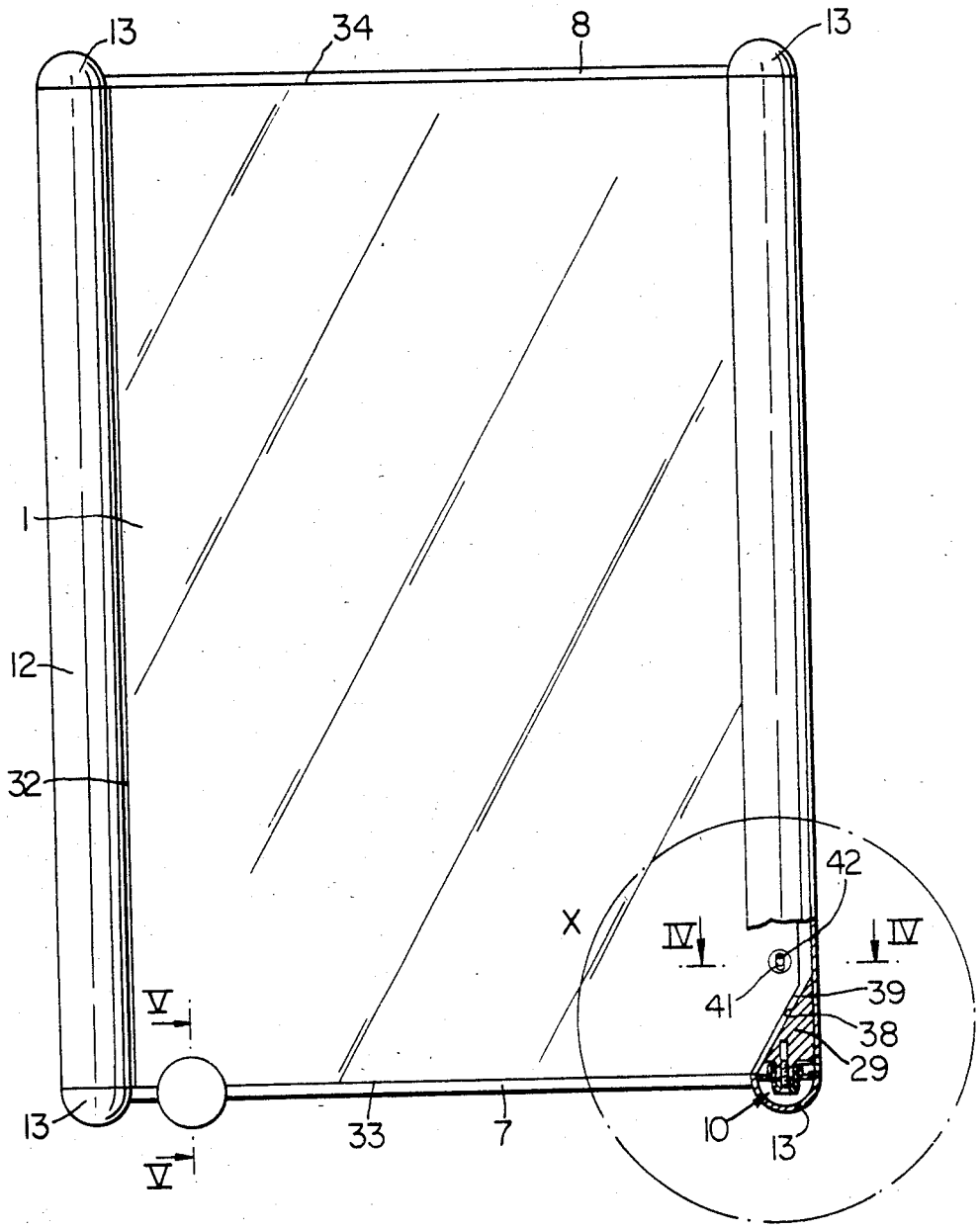
FIG. 6 is the front view of the cabinet of FIG. 1, but partially broken in the hinge area.
Figure 7:
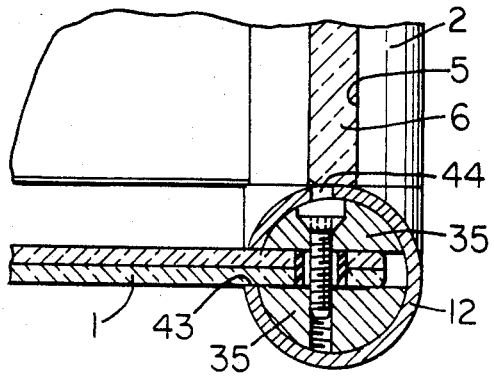
FIG. 7 is a section along the line IV—IV of FIG. 6.
Figure 8:
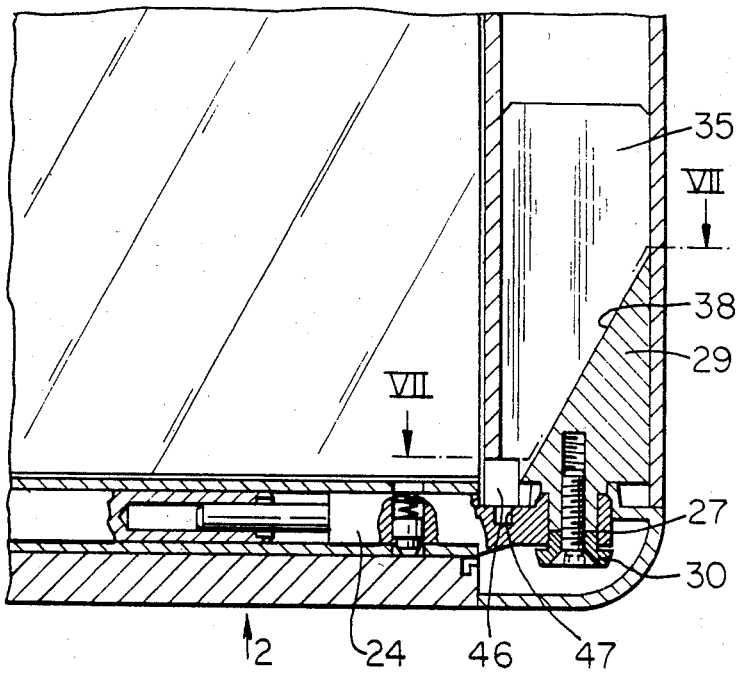
FIG. 8 is a section similar to that of FIG. 4 but showing the hinge area of the left lower portion of the cabinet of FIG. 1 as viewed from the left side.
Figure 9:
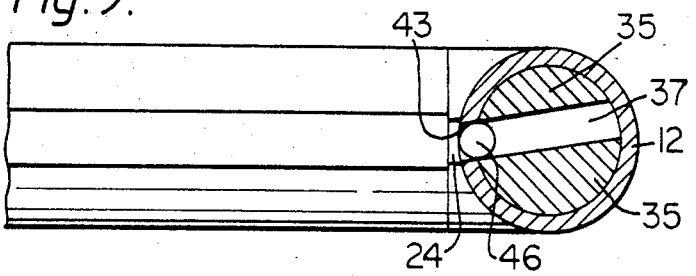
FIG. 9 is a section along the line VII—VII of FIG. 8.

At the side of the door panel 1 lying opposite the hinges 10, i.e., in FIGS. 1 and 6 on the left-hand side of the cabinet, there are suitably arranged hinges corresponding to the hinges 10, whose sole objective is to support the facing 12 and to impart thereby an attractive appearance to the door. In order that the facings 12 slipped over the clamping bushings of these hinges should not be permitted so to rotate with respect to the bearing bolts that their longitudinal slots 43 become visible, rotation-proofing elements (FIGS. 8 and 9) are associated with the hinges 10. These consist for instance of a pin 46 inserted into a bore 47 of the bearing pin 24, the enlarged head of which comes to be situated in the longitudinal slot 43 and, if necessary, also in the receiving gap 37 and comes packaged with the mirror cabinet so that it can, depending on the side on which the door panel is hung, be inserted into the bore 47 on the right or on the left side of the cabinet. The pin can be permanently screwed in or cemented. As shown in FIGS. 8 and 9, the clamping bushing 29 of of FIG. 9 is rotated with an angle of 90° with respect to the clamping bushing 29 as shown in FIG. 3 such that the receiving gap 37 faces the supporting arm 2.

The cover caps 13 (FIGS. 4 and 5) serve for the covering of the hinge sections and of the unattractive gaps, respectively interstices, between the ends of the supporting arms 2 and the ends of the facings 12, which are still visible after the slipping on of the facings 12. The cover caps 13 are slipped on in the direction of the hinge axis and provided with undercuts 48 which, in the joined state, snap in behind the inner edge of the sleeves 27. Moreover, the cover caps 13 have abutment ends 49 and 50 that lie against the ends of the supporting arms 2, and the facings 12, respectively. The outer shape of the cover caps 13 can be selected in such a way as to yield the configuration of a quarter-sphere. Owing to a wedge-shaped bevelling of the holding caps 30, the slipping on of the cover caps 13 is facilitated.

Figure 10:
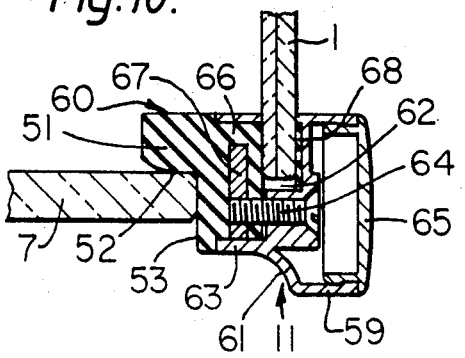
FIG. 10 is a section along the line V—V of FIG. 6.

The fitting 11 (FIGS. 1 and 10) serving for the opening and closing of the door panel 1 is secured to the lower end of the door panel 1 and acts as a handle, closing, and abutment element. It contains an outer portion 59 arranged at the outside of the door panel 2 and serving as a handle and an inner portion 60, connected therewith, situated on the other side of the door panel 1, which has an abutment surface 53 and a clamping surface 52 that is arranged substantially perpendicular to the abutment surface 53, so that the inwardly directed side of the inner portion 60 is formed in the manner of an angle element.

The outer portion 50 consists of a substantially cylindrical lower part whose inwardly directed end is tapered to form a handle depression 61. In a central portion and radially opposite the handle depression 61 the outer portion 59 has a radial, U-shaped recess 62 which serves for the slipping of the fitting 11 on the door panel 1 and on the other side is bounded by a clamping surface, however on the inner side only by a semi-circular section 63 forming a receiving opening for the inner portion. Beneath a section of the material of the outer portion 59 forming the bottom of the recess there is provided a bearing bore parallel to the center axis for a setscrew 64. At the outer end, the outer portion 59 has an annular undercut which, with a corresponding undercut at a cover cap 65 that can be slipped onto the outer end, forms a snap-in closure.

The inner portion 60 has at its end directed outwardly, respectively at its end directed toward the door panel 1, a semicircular projection 66 whose outer contour corresponds substantially to the iner contour of the section 63 and which, accordingly, can be pushed into this section 63. The axial length of the projection 66 is so great that its outer end surface projects in the joined state adjacent the recess 62.

In the projection 66 there is formed a pocket with a radial opening, which serves for the accommodating of a filler element 67. While the projection 66 has a bore the axis of which is oriented perpendicular to the abutment surface 53 and which is, in the joined state, aligned with the bearing bore of the outer portion 59, the filler element 67 has a threaded bore which, in the joined state, is oriented coaxially with the other bores and serves for the screwing in of the threaded portion of the setscrew 64. Besides, the length of the filler element 67 in radial direction is so determined that, in its joined state, it is arranged completely inside the pocket.

For the securing of the door fitting 11 to the door panel 1 one proceeds as follows. After the recess 62 has been applied in the manner of a U onto the door panel 1, the fitting 11 is displaced parallel to the door up to the point at which it is to be secured. Subsequently, the door panel 1 is closed and the setscrew 64 tightened lightly. Finally, through repeated opening and closing of the door panel 1, one checks whether the clamping surface 52 has the proper spacing to the bottom plate 7 and does therefore close gently but tightly, in conjunction with which by displacement of the outer portion 59, there can be adjusted the proper elevation as well as the parallelism of the clamping surface 52 to the bottom plate 7. Finally, the setscrew 64 is tightened.

Of advantage in this embodiment is, above all else, that the setscrew 64 does not project through any door bore. A firm seating of the door fitting on the door panel is guaranteed in that the end surface of the projection 66 is, upon tightening of the setscrew 64, forced increasingly harder against the door panel 1 and the latter is therefore clamped between the end surface and the oppositely situated clamping surface of the outer portion 59 that much harder the more the setscrew 64 is tightened. Even if the inner portion consists of a soft rubber or a rubber-like material, this causes no problems because, on the one hand, the filler element 67 consisting of metal or of another bending-resistant material controls the section of material situated between the same and the door panel 1 and, on the other hand, the section 63 acts as an annular or can-shaped stiffening element. Furthermore, it is advantageous that the door fitting can be secured at any point of the door panel, as long as the bottom plate 7 faces the clamping surface 52. Alternatively, the door fitting could however be secured also to the upper end of the door panel and cooperate there with the top plate 8 illustrated in FIG. 1. Finally, the door fitting could be mounted even on a side edge of the door panel, as long as a suitable partition or end wall of the cabinet is provided there. Moreover, it is advantageous that not the door panel itself, but rather the abutment surface 53 acting as a buffer limits the closing operation so that sensitive doors, in particular glass or plate glass doors, cannot be damaged. It is finally also advantageous that only one single setscrew is needed for the assembly and that the same is accessible from the outside.

In order to make it utterly impossible for the door fitting 11 to be displaced on the door panel, the clamping surface of the outer portion 59 is preferably coated with a layer 68 of a slip-resistant material. Particularly suitable for this purpose have proven to be highly elastic polyurethane-based elastomers which are being marketed by the firm 3M Deutschland GmbH under the designation "Bumpon".

Following completed assembly, the cover cap 65 is pressed on, so that the end state evident from FIG. 5 results and the setscrew 64 is invisible.

As a result that the fitting 11 can be slipped with its recess 62 more or less far onto the door panel 1, its effect as a handle, closing, and abutment element can at all times be adapted to the respective position and arrangement of the door panel within the framework formed by the supporting arms 2. The fitting 11 can therefore be used optimally with pieces of furniture having the door bearing according to the invention.

In order to render impossible a slippage of the door panel 1 in the receiving gap 37, the clamping jaws 35 are, in the area of their clamping surfaces 36, coated (FIG. 4) preferably with a layer 54 made of an elastomer of high slip resistance, e.g., the mentioned "Bumpon". The mirror holders 3 can also be coated with corresponding layers.

In the bearing bores 42 formed in the door panel 1 there are suitably inserted protective rings 55 made of plastics material that prevent a contact of the clamping screw 41 with the door panel 1 (FIG. 4).

The supporting arms 2, the hinges 10, and the facings 12 are preferably arranged and designed in such a way that, with the door in its assembled state, after removal of the cover caps 13, all filler elements 9 and the bottom and top plates, 7 and 8 respectively, can be removed from the supporting frame. This has the advantage that even subsequently and without disassembly of the door additional plates can be inserted for the purpose of mounting connecting shelves or the like or replacing the existsing plates. Following the releasing of a bearing pin 24 from its respective clamping bushing 29 by means of the setscrew 31, the facing 12 can furthermore be exchanged respectively slid on subsequently. A subsequent removal of the side walls 6 is possible however only following prior disassembly of the hinges 10.

The supporting arms 2, the facings 12, and the cover caps 13 consist preferably of plastics material injection-molded parts. This has the advantage that these inexpensive parts can be held in stock at the manufacturer and dealer in a multiplicity of colors, whereas the relatively expensive doors and also the hinges need to be on hand in only one single color.

The assembly of the doors at the ultimate user is extremely simple by means of the door mounting according to the invention. The hinges 10 and the facings 12 can be preassembled on the door panels already in the plant. At the user's, it is then necessary only to mount the supporting arms 2, and to press on the cover caps 13. The spring bolts 25 thereby rest automatically in the predetermined position of the bearing pins 24 and are then still accessible only from a longitudinal groove 5. Since the parts inserted into the longitudinal grooves 5 can however be removed even with the door mounted, the door can be disassembled at any time as needed. There is thus rendered possible an axially secure, rotation-proof and disassembly-proof plug-in assembly of the bearing pins 24, a very simple assembly of the door and a delivery in the finished state of the door with pre-assembled bearing pins.

The invention is not limited to the described exemplified embodiments, rather it can be modified in a variety of ways. In lieu of the described storage elements or in addition thereto can be provided other storage elements, e.g., in the form of holders for tooth cleaning glasses, toothbrushes, shavers, or the like.

Furthermore it is not necessary to provide the door mounting according to the invention on mirror cabinets or the described supporting arms, because the advantages intended by the invention can be realized with any type of cabinet and supporting arm.

In lieu of the rotation-proofing achieved by the square profile of the bearing pins 24, which prevents a swinging away of the clamping bushings 29 out of the vertical position above all else during adjusting of the door gap and therefore facilitates the adjusting process, other rotation-proofing means can be provided. In many instances, the rotation-proofing provided solely by the spring bolt 25 ought to be adequate. Accordingly, in lieu of the rotation-proofing 46 illustrated in FIGS. 8 and 9 for the facings 12, other rotation-proofing means, for instance in the form of plates or disks could be provided, which engage not only the longitudinal slot 43 of the facing, but secure also the associated clamping bushing against rotation, even though the latter would not be absolutely essential.

Figure 11:
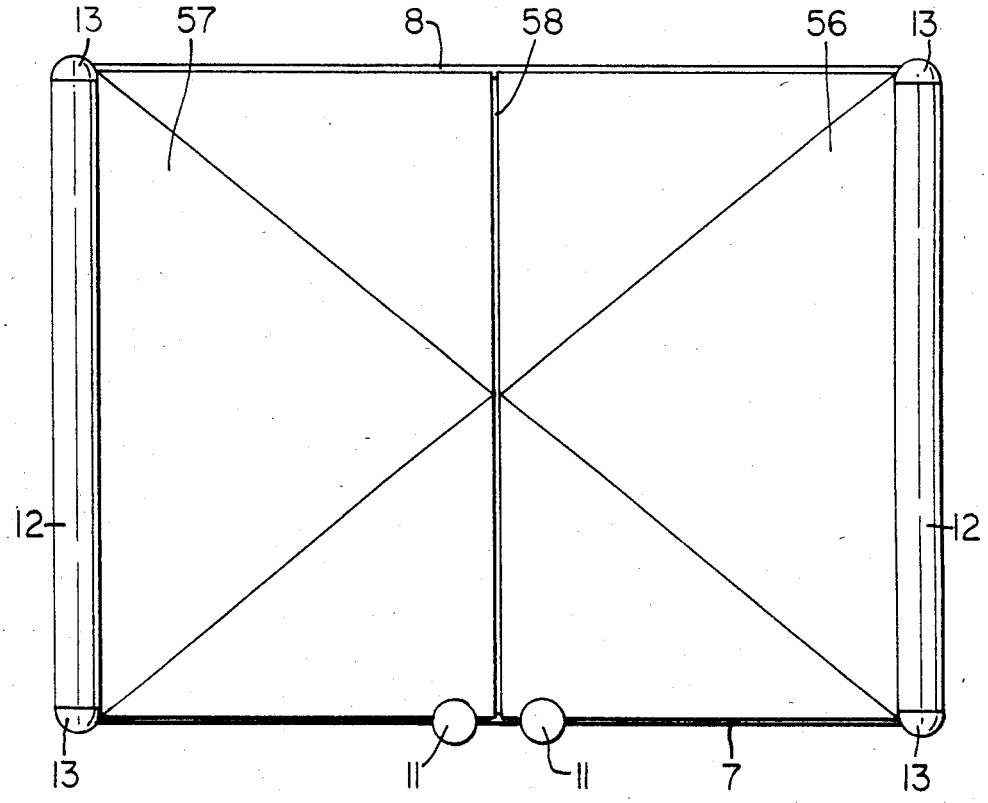
FIG. 11 is the front view of a mirror cabinet with two door panels according to a second embodiment of the invention.

Moreover, the invention is not limited only to cabinets or shelves having only one door panel. FIG. 11 schematically illustrates a mirror cabinet with two door panels 56 and 57 with otherwise like designation of the parts already described. In this regard, the door mountings in accordance with the invention, which are concealed by the facings 12 and the cover caps 13, render possible also even after the assembling of the door panels 56 and 57 a fine adjustment, in particular of the gap 58 occurring at the contact location of the two door panels.

Even the supporting arms and the means for securing the hines thereto can be designed otherwise than as shown. Advantageous is, finally, also an embodiment in which the clamping bushings 29 and the facing 12 are replaced by a continuous bearing pipe that is secured to the front ends of the supporting arms and, like the facing 12, has a longitudinal slot in which the hinge side door panel edge is concealed as well as laterally and elevationally adjustably secured, in order that, even after the mounting of the door panel, all required adjustments can be performed.

Finally, provision can be made to replace the mirror 4 and the mirror supports 3 by a rear wall of a different type, which could likewise be combined with the supporting arms 2 into a structural unit and be for instance firmly connected with the same.

I claim:

1. A piece of furniture, particularly a cabinet, comprising: at lease one bottom plate, one top plate being parallel with said bottom plate and two side walls being parallel with each other and being arranged with an angle with respect to said bottom and top plate, said plates and walls having supporting ends at opposite sides thereof: at least four spaced and parallel supporting arms for connecting and supporting said plates and walls, each supporting arm having a front and a rear end, a receiving opening bordering the front end and at least two elongated first slots extending between said front and rear ends for receiving respective ones of said supporting ends of said plates and means such that said plates and walls form said furniture and define at least one opening thereof; a door having at least one door leaf with a side edge, said door leaf being supported by two selected ones of said supporting arms; at least one bearing body having two mounting ends, extending between said selected supporting arms and having a second elongated slot receiving and concealing said side edge of said door leaf, said side edge being adjustably mounted within said second slot for adjustment of the door leaf with respect to said plates and walls; and at least two hinges each having a hinge axis, said hinges rotatably supporting said bearing body between said selected arms, each hinge having a frame portion including a bearing pin one end of which is inserted into and held within the receiving opening of one of said selected supporting arms and the other end of which projects from said last-mentioned receiving opening, and a leaf portion being provided at each of said ends of said bearing bodies and being connected to said projecting end of a respective one of said frame portions in a manner rotatably about the respective hinge axis such that said bearing body together with said door leaf may be rotated for opening and closing said opening.

2. Piece of furniture according to claim 1, characterized in that the bearing body is a tubular facing and the leaf portions comprise clamping bushings received in the mounting ends of the bearing-body, the clamping bushings have two clamping jaws embracing the side edge of the door leaf.

3. Piece of furniture according to claim 2, characterized in that the clamping bushings comprise cylindrical bodies coaxial with the hinge axis and each having a U-shaped receiving gap receiving said side edges.

4. Piece of furniture according to claim 3, characterized in that the clamping bushings are mounted in such a way in the two ends of the respective bearing bodies that the receiving gap of the one clamping bushing embraces said side edge of the door leaf at one end thereof whereas the receiving gap of the other clamping bushing embraces said side edge of the door leaf at the opposite end thereof.

5. Piece of furniture according to claim 3, characterized in that the bottom of at least one receiving gap is inclined with respect to the respective hinge axis and that at least one end of said side edges of the door leaf embraced by said at least one receiving gap has a cutout corresponding to the inclined bottom.

6. Piece of furniture according to claim 3, characterized in that there is provided binding screws and the clamping jaws of each clamping bushing are traversed by a bore, that the portions of the door leaf to be embraced by said receiving gaps have bores whose cross-sections are larger than the cross-sections of the bores of said clamping jaws, that one of said binding screws projects through said bores of said clamping jaws of each clamping bushing and said respective portions of said door leaf for clamping said portions between said clamping jaws, and that each mounting end of said bearing body has an assembly bore cooperating with said bores of said clamping jaws.

7. Piece of furniture according to claim 1, characterized in that each bearing pin has a longitudinal axis, and that each bearing pin and the respective receiving opening of the supporting arm have cooperating stop elements for fixing the location of the hinges in a predetermined position, said stop elements consisting of a spring bolt mounted within and being arranged perpendicular to the longitudinal axis of the bearing pin and a cross bore in the supporting arm and opening into said receiving opening for receiving said spring bolt.

8. Piece of furniture according to claim 7, characterized in that the bearing pins are non-rotatably mounted in the supporting arms.

9. Piece of furniture according to claim 1, characterized in that the supporting arms are born on stay-bolts having a four-edge profile and two ends, one of which ends having a coaxial bore, and that the bearing pins are provided with extensions which project into the axial bores.

10. Piece of furniture according to claim 1, characterized in that cover caps are provided extending between the front sides of the supporting arms and the respective ends of the bearing body.

11. Piece of furniture according to claim 2, characterized in that each clamping bushing has at one end a cylindrical projection coaxial with the hinge axis, that at that end of each bearing pin which projects from the respective receiving opening a sleeve is provided coaxial with the hinge axis, and that each projection is rotatably journaled in a respective one of said sleeves.

12. Piece of furniture according to claim 1, characterized in that the supporting arms have four of said elongated slots staggered by 90° each and that filler elements are provided, said filler elements having an outside contour corresponding to the contour of said slots such that the filler elements may be inserted into said slots and removed therefrom.

13. Piece of furniture according to claim 2, characterized in that said clamping jaws are coated with a layer of slip-resistant material.

14. Piece of furniture according to claim 1, further comprising: at least two supporting arms which are not selected to support said door leaf, a further bearing body having two mounting ends and two further hinges each having a frame portion and a leaf portion, said frame portions being inserted into respective ones of said receiving openings of said further supporting arms and said leaf portions being inserted into respective ones of said mounting ends of said further bearing body.

* * * * *